US006729378B2

(12) United States Patent
Simon et al.

(10) Patent No.: US 6,729,378 B2
(45) Date of Patent: May 4, 2004

(54) DEVICE FOR SEALING GUIDING SLIDEWAYS FOR A HANDLING DOOR

(75) Inventors: Bernard Simon, Caluire et Cuire (FR); Antonella LaMarca, Pierre-Benite (FR)

(73) Assignee: Maviflex S.A., Villeurbanne (FR)

( * ) Notice: Subject to any disclaimer, the term of this patent is extended or adjusted under 35 U.S.C. 154(b) by 0 days.

(21) Appl. No.: 10/366,555

(22) Filed: Feb. 14, 2003

(65) Prior Publication Data

US 2003/0155082 A1 Aug. 21, 2003

(30) Foreign Application Priority Data

Feb. 18, 2002 (FR) ..... 02 01997

(51) Int. Cl.[7] ..... A47H 5/00

(52) U.S. Cl. ..... 160/84.06; 160/84.01; 160/271; 160/273.1

(58) Field of Search ..... 160/84.01, 84.06, 160/133, 41, 118, 266, 271, 273.1, 272, 264, 268.1, 269

(56) References Cited

U.S. PATENT DOCUMENTS 4,294,040 A * 10/1981 Crotti ..... 49/254
4,374,536 A * 2/1983 Becker ..... 160/84.06
5,219,015 A * 6/1993 Kraeutler ..... 160/271
5,544,690 A * 8/1996 Magro et al. ..... 160/133
5,794,678 A * 8/1998 Beringer et al. ..... 160/41
5,846,127 A * 12/1998 Kile ..... 454/195
6,192,960 B1 * 2/2001 Simon ..... 160/84.06
6,481,487 B2 * 11/2002 Simon ..... 160/84.06
6,574,832 B1 * 6/2003 Boerger et al. ..... 16/90
2003/0079844 A1 * 5/2003 DeBlolck et al. ..... 160/31

FOREIGN PATENT DOCUMENTS

DE 4007280 * 8/1991 ..... 160/271 X
FR 2807784 10/2001

OTHER PUBLICATIONS

Copy of the International Search Report and Annex.

* cited by examiner

*Primary Examiner*—Bruce A. Lev
(74) *Attorney, Agent, or Firm*—Greenblum & Bernstein, P.L.C.

(57) ABSTRACT

A handling door that includes vertical opposed uprights. Each upright has vertical guide slideways. Each vertical guide slideway is at least one of a semirigid member and a flexible member and includes one of a woven material, a deformable plastic material, and a shape-memory material. Ribs project from an outer face of each upright. The vertical guide slideways of each upright are arranged between the ribs. This abstract is neither intended to define the invention disclosed in this specification nor intended to limit the scope of the invention in any way.

21 Claims, 2 Drawing Sheets

DEVICE FOR SEALING GUIDING SLIDEWAYS FOR A HANDLING DOOR

CROSS-REFERENCE TO RELATED APPLICATIONS

The present application claims priority under 35 U.S.C. §119 of French Application No. FR 02 01997 filed on Feb. 18, 2002, the disclosure of which is expressly incorporated by reference herein in its entirety.

BACKGROUND OF THE INVENTION

1. Field of the Invention

The present invention relates to a handling door of the type with a flexible curtain or apron for an industrial building, and more particularly to a guide device for the vertical slideways of said door.

2. Discussion of Background Information

Doors of this type generally comprise a metal structure or framework consisting of vertical and opposed uprights, of a drive shaft, of several horizontal reinforcing bars housed in sleeves made in the thickness of the flexible curtain or apron, and of hauling straps.

The vertical edges of the flexible curtain or apron and the horizontal reinforcing bars or reinforcing tubes run in vertical slideways which may or may not be held on the vertical uprights of the handling door.

The vertical guide slideways have a spacing which is somewhat greater than the thickness of the curtain so as to allow it to move from an open position to a closed position when the hauling straps are driven by the drive shaft.

SUMMARY OF THE INVENTION

One purpose of the present invention aims to solve the problem of sealing the flexible apron in the vertical guide slideways when the latter are semirigid or flexibly fixed, at their two ends, to each upright of the metal framework and made of woven materials or deformable plastics materials or shape-memory materials.

The sealing device according to the present invention may utilize projecting ribs which are secured to the outer face of each upright and between which are arranged, in close proximity, the elements of each guiding slideway.

The sealing device according to the present invention may utilize projecting ribs which arise from a shaping of the outer face of each upright.

The sealing device according to the present invention may utilize projecting ribs which are made of attached elements fixed to the outer face of each upright.

The sealing device according to the present invention may utilize projecting ribs which are continuous and are provided along the entire height of the guiding slideways.

The sealing device according to the present invention may utilize projecting ribs which may be parallel or in the shape of a V depending on the direction of the elements of the guiding slideway on the outer face of each upright.

The invention also provides for a handling door comprising vertical opposed uprights. Each upright has vertical guide slideways. Each vertical guide slideway is at least one of a semirigid member and a flexible member and comprises one of a woven material, a deformable plastic material, and a shape-memory material. Ribs project from an outer face of each upright. The vertical guide slideways of each upright are arranged between the ribs.

The handling door may further comprise a flexible apron or curtain whose ends are guided by the vertical guide slideways. The ribs may be formed by shaping or bending the outer face of each upright. The ribs may be fixed to the outer face of each upright. The ribs may be at least one of continuous and provided over an entire height of the vertical guide slideways. The ribs may be arranged parallel to one another on each outer face. The ribs may be arranged in a non-parallel manner to one another on each outer face. Each rib may have a V-shape. The ribs may slope towards one another. A distance between the ribs may be greater than a distance between vertical guide slideways.

The invention also provides for a handling door comprising two vertical opposed uprights. Each upright has two vertical guide slideways. Each vertical guide slideway comprises one of a woven material, a deformable plastic material, a shape-memory material. Two ribs project from an outer face of each upright. The two vertical guide slideways of each upright are arranged between the two ribs of each upright.

The handling door may further comprise a flexible apron or curtain whose ends are guided by the vertical guide slideways. Each rib may be formed by shaping or bending the outer face of each upright. Each rib may be fixed to the outer face of each upright. Each rib is at least one of continuous and provided over an entire height of the vertical guide slideways. The two ribs may be arranged parallel to one another on each outer face. The two ribs may be arranged non-parallel to one another on each outer face. Each rib may have a V-shape. The two ribs may slope towards one another. A distance between the two ribs may be greater than a distance between two vertical guide slideways.

The invention also provides for a handling door comprising two vertical opposed uprights. Each upright includes two vertical guide slideways. Each vertical guide slideway comprises a flexible strap. Two ribs project from an outer face of each upright. The two vertical guide slideways of each upright are arranged between the two ribs of each upright and each rib acts to limit movement of each strap by engaging therewith.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
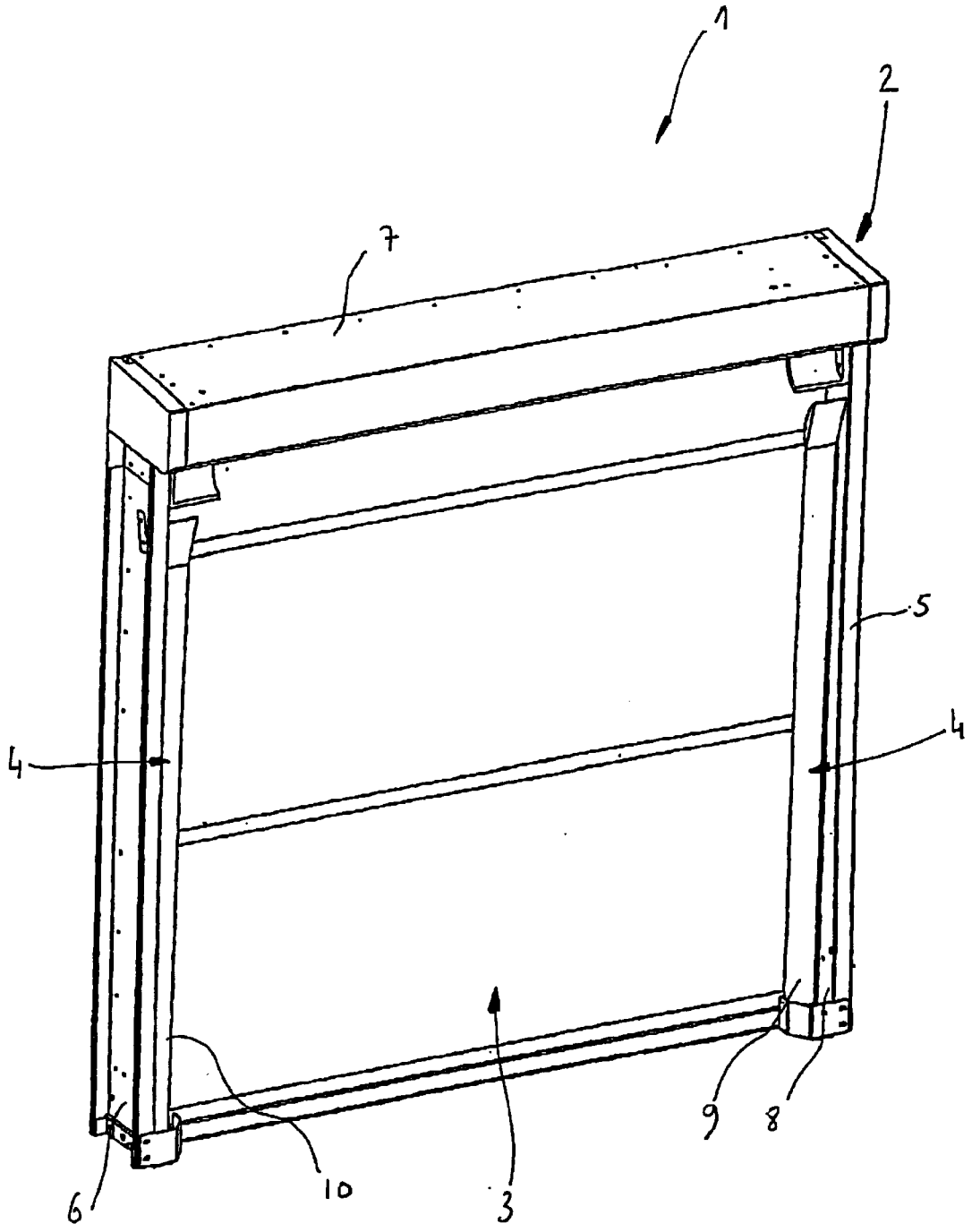
FIG. 1 is a perspective view illustrating a handling door of the flexible curtain or apron type for an industrial building, and a guide device for the vertical slideways of the door according to the present invention.
Figure 3:
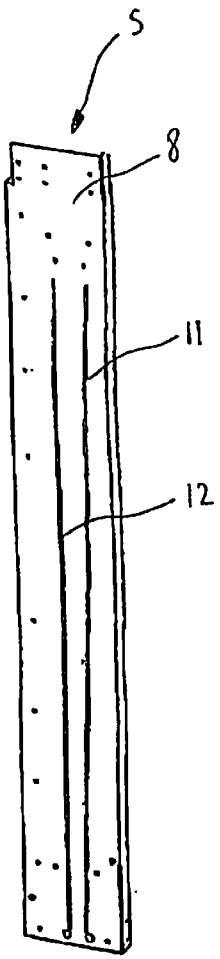
FIG. 3 is a perspective view showing the sealing arrangement forming the guiding device for the vertical slideways of the door according to the present invention.

FIG. 1 depicts a handling door 1 for an industrial building comprising a metal framework 2, a flexible apron or curtain 3 and guiding slideways 4.

The metal framework 2 utilizes two vertical and opposed uprights 5 and 6 which are fixed against the vertical wall faces of a wall of an industrial building in which wall an opening that is to be closed-off is made.

The opposed and vertical uprights 5 and 6 are connected together in the upper part of the handling door 1 by a motorized winding drum, not depicted, protected by a cover 7.

The winding drum is mechanically connected at one of its ends to a brake/geared motor assembly, not depicted, fixed in the upper part of a vertical upright 5, 6 and allowing the flexible apron 3 to be moved vertically between an open position and a closed position.

Each vertical upright 5, 6 comprises, on its outer face 8, a guiding slideway 4 formed, for example, of deformable elements 9, 10 allowing the flexible apron 3 and its horizontal crosspieces to be guided in their vertical movements between an open position and a closed position.

Figure 2:
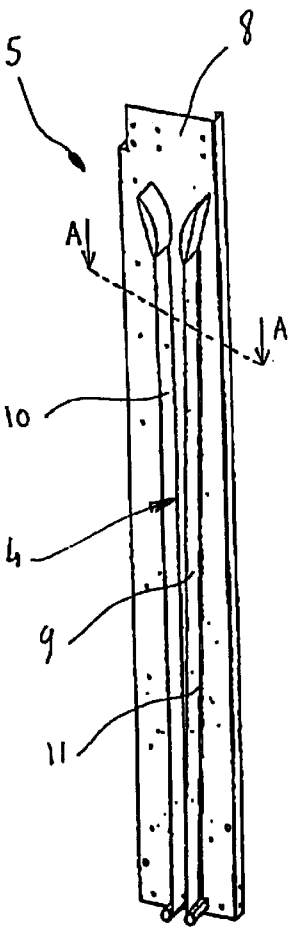
FIG. 2 is a perspective view depicting an upright of the metal framework of the handling door provided with the vertical guide slideways.
Figure 4:
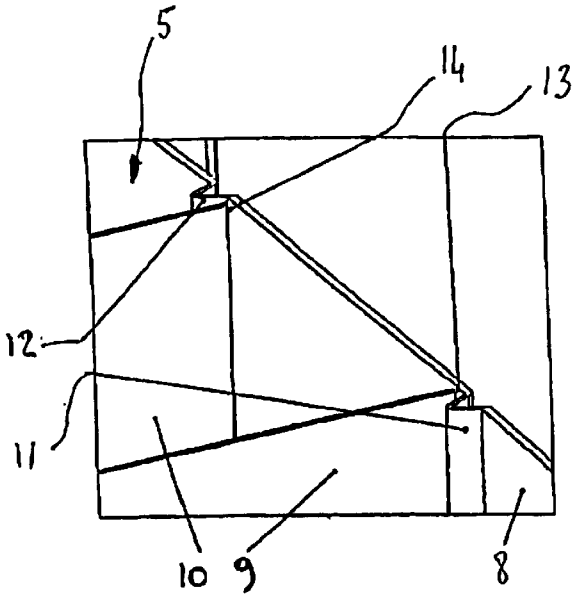
FIG. 4 is a view illustrating, in detail, the sealing arrangement made in each upright of the metal framework of the handling door.

FIGS. 2 and 4 show only the vertical upright 5 of the handling door 1, given that the other one, 6, is generally identical in arrangement.

Thus, the vertical upright 5 comprises, on its outer face 8, ribs 11, 12 forming the device for sealing with the continuous edges 13, 14 of the straps 9, 10 of the guiding slideway 4.

It may be noted that the elements 9, 10 of the guiding slideway 4 are arranged between the ribs 11, 12 in such a way that the ribs 11, 12 are positioned and/or arranged outside the slideway.

The ribs 11 and 12 are designed to be continuous along the entire height of the slideway 4 and along the external profile thereof. However, the invention also contemplates that these ribs can be formed intermittently (not shown). In this case, the ribs would have small gaps between the projecting portions of the ribs.

The ribs 11 and 12 may be arranged parallel to each other or in the shape of a V, i.e., sloping towards each other, depending on the position of the elements 9, 10 of the slideway 4 on the outer face 8 of the upright 5.

The ribs 11, 12 allow each element 9, 10 of the slideway 4 to improve the sealing with respect to the upright 5 while at the same time allowing the straps the possibility of deforming when the flexible apron 3 is subjected to an abnormal lateral thrust.

The sealing device utilizes the ribs 11, 12 and is designed to suit all types of slideways 4, especially the types which are able to deform or to pivot with respect to the upright 5 when an external pressing force is exerted on the flexible apron 3.

It may be noted that the ribs 11, 12 arise from a shaping and/or bending of the outer face 8 of the upright 5 according to the position of the elements 9, 10 of the slideway 4.

It is apparent that the sealing of the flexible apron 3 within the elements 9, 10 of the guiding slideway 4 is achieved via ribs 11, 12 formed in each upright 5, 6 against which said elements of the slideway temporarily bear. Of course the ribs 11 and 12 can also have a shape that is different than that shown and can even be formed separately from the uprights 5 and thereafter attached by, e.g., bonding, fastening and/or welding.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

What is claimed:

1. A handling door comprising:

vertical opposed uprights;

each upright having vertical guide slideways;

each vertical guide slideway being at least one of a semirigid member and a flexible member and comprising one of a woven material, a deformable plastic material, and a shape-memory material; and ribs which project from an outer face of each upright, wherein the vertical guide slideways of each upright are arranged between the ribs.

2. The handling door of claim 1, further comprising one of a flexible apron or curtain whose ends are guided by the vertical guide slideways.

3. The handling door of claim 1, wherein the ribs are formed by one of shaping or bending the outer face of each upright.

4. The handling door of claim 1, wherein the ribs are fixed to the outer face of each upright.

5. The handling door of claim 1, wherein the ribs are at least one of continuous and provided over an entire height of the vertical guide slideways.

6. The handling door of claim 1, wherein the ribs are arranged parallel to one another on each outer face.

7. The handling door of claim 1, wherein the ribs are arranged non-parallel to one another on each outer face.

8. The handling door of claim 1, wherein each rib has a V-shape.

9. The handling door of claim 1, wherein the ribs slope towards one another.

10. The handling door of claim 1, wherein a distance between the ribs is greater than a distance between the vertical guide slideways.

11. A handling door comprising:

two vertical opposed uprights;

each upright having two vertical guide slideways;

each vertical guide slideway comprising one of a woven material, a deformable plastic material, and a shape-memory material; and two ribs which project from an outer face of each upright, wherein the two vertical guide slideways of each upright are arranged between the two ribs of each upright.

12. The handling door of claim 11, further comprising one of a flexible apron or curtain whose ends are guided by the vertical guide slideways.

13. The handling door of claim 11, wherein each rib is formed by shaping or bending the outer face of each upright.

14. The handling door of claim 11, wherein each rib is fixed to the outer face of each upright.

15. The handling door of claim 11, wherein each rib is at least one of continuous and provided over an entire height of the vertical guide slideways.

16. The handling door of claim 11, wherein the two ribs are arranged parallel to one another on each outer face.

17. The handling door of claim 11, wherein the two ribs are arranged in a non-parallel manner to one another on each outer face.

18. The handling door of claim 11, wherein each rib has a V-shape.

19. The handling door of claim 11, wherein the two ribs slope towards one another.

20. The handling door of claim 11, wherein a distance between the two ribs is greater than a distance between two vertical guide slideways.

21. A handling door comprising:

two vertical opposed uprights;

each upright including two vertical guide slideways;

each vertical guide slideway comprising a flexible strap; and two ribs which project from an outer face of each upright, wherein the two vertical guide slideways of each upright are arranged between the two ribs of each upright, and wherein each rib acts to limit movement of each strap by engaging therewith.

* * * * *